US008229608B2

(12) United States Patent
Yamamura et al.

(10) Patent No.: US 8,229,608 B2
(45) Date of Patent: Jul. 24, 2012

(54) OUTBOARD MOTOR CONTROL APPARATUS

(75) Inventors: Makoto Yamamura, Saitama (JP); Yoshihisa Shinogi, Saitama (JP); Manabu Dobashi, Saitama (JP); Kazuhiro Sato, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 813 days.

(21) Appl. No.: 12/286,783

(22) Filed: Oct. 2, 2008

(65) Prior Publication Data

US 2009/0105894 A1 Apr. 23, 2009

(30) Foreign Application Priority Data

Oct. 19, 2007 (JP) ..... 2007-272643

(51) Int. Cl.
*B60L 3/00* (2006.01)

(52) U.S. Cl. ..... 701/21

(58) Field of Classification Search ..... None
See application file for complete search history.

(56) References Cited

U.S. PATENT DOCUMENTS

| | | | | |
|---|---|---|---|---|
| 5,476,426 | A * | 12/1995 | Nakamura et al. | 477/115 |
| 6,505,595 | B1 * | 1/2003 | Koerner | 123/179.5 |
| 6,604,064 | B1 * | 8/2003 | Wolff et al. | 703/7 |
| 6,859,692 | B2 * | 2/2005 | Okuyama | 701/21 |
| 6,937,954 | B2 * | 8/2005 | Jeong et al. | 702/92 |
| 6,997,764 | B2 | 2/2006 | Okuyama et al. | |
| 7,444,213 | B2 * | 10/2008 | Motose | 701/21 |
| 2004/0059478 | A1 * | 3/2004 | Okuyama | 701/21 |
| 2006/0252316 | A1 * | 11/2006 | Tawa et al. | 440/61 S |
| 2007/0270055 | A1 * | 11/2007 | Ito et al. | 440/87 |
| 2008/0119095 | A1 * | 5/2008 | Hiroshima et al. | 440/84 |
| 2009/0180354 | A1 * | 7/2009 | Sander et al. | 367/197 |

FOREIGN PATENT DOCUMENTS

| | | | |
|---|---|---|---|
| JP | 2002-160696 | A | 6/2002 |
| JP | 2002-278763 | A | 9/2002 |
| JP | 2004-124586 | A | 4/2004 |
| JP | 2005-071077 | A | 3/2005 |
| JP | 2005-161906 | A | 6/2005 |
| JP | 2006-282171 | | 10/2006 |

* cited by examiner

*Primary Examiner* — Thomas Tarcza
*Assistant Examiner* — Nagi Murshed
(74) *Attorney, Agent, or Firm* — Carrier Blackman & Associates, P.C.; Joseph P. Carrier; William P. Blackman

(57) ABSTRACT

In an apparatus installed on a boat for identifying and controlling operation of an outboard motor selected by an operator and clamped to the boat from among outboard motors in different models prepared to be selectable by the operator, including a model having an analog device that produces analog signal and a model having a digital device that converts the analog signal produced by the analog device into a digital signal, it is discriminated whether the inputted signal is the analog signal inputted through the analog signal input/output or the digital signal inputted through the digital signal input/output, and the model of the selected outboard motor is identified based on the discriminated signal, thereby enabling to surely identify the model and control its operation.

8 Claims, 4 Drawing Sheets

OUTBOARD MOTOR CONTROL APPARATUS

BACKGROUND OF THE INVENTION

1. Field of the Invention

This invention relates to an outboard motor control apparatus, particularly to an outboard motor control apparatus that identifies selected one from among outboard motor models and controls its operation.

2. Description of the Related Art

Japanese Laid-Open Patent Application No. 2006-282171 teaches a control apparatus for an outboard motor with a so-called DBW (Drive By Wire) mechanism. Specifically, the outboard motor is equipped with a steering actuator, a throttle actuator and an electronic control unit, and the operation of the actuators are controlled by the unit to steer the outboard motor and regulate the engine speed in response to the operator's command detected by the steering wheel angle sensor and throttle lever position sensor. Devices including the sensors are installed on the boat and are connected, via bus, to the unit that is installed in the outboard motor.

Since the outboard motors are different in engine power by the model, there may be a need that several outboard motor models are prepared to be selectable for an intended purpose such that the selected outboard motor is controlled by a control unit installed on the boat. In that case, the control unit must identify the model of the selected outboard motor in order to control its operation.

It will be conceivable to add a switch at a cockpit for enabling the operator to input a code signal indicative of the model of the selected outboard motor. However, the input of the code signal is tedious and if the signal is inputted erroneously, it becomes difficult to control the operation of the selected outboard motor.

SUMMARY OF THE INVENTION

An object of this invention is therefore to solve the problem by providing an outboard motor control apparatus installed on a boat that can surely identify one from among outboard motor models selected by an operator and clamped to the boat and control its operation.

In order to achieve the object, this invention provides an apparatus installed on a boat for identifying and controlling operation of an outboard motor selected by an operator and clamped to the boat from among outboard motors in different models prepared to be selectable by the operator, the outboard motors including a model having an analog device that produces analog signal and a model having a digital device that converts the analog signal produced by the analog device into a digital signal, comprising: an analog signal input/output that is able to input/output the analog signal produced by the analog device; a digital signal input/output that is able to input/output the digital signal produced by the digital device; and a model identifier that discriminates whether the inputted signal is the analog signal inputted through the analog signal input/output or the digital signal inputted through the digital signal input/output, and identifies the model of the selected outboard motor based on the discriminated signal.

BRIEF DESCRIPTION OF THE DRAWINGS

The above and other objects and advantages of the invention will be more apparent from the following description and drawings in which.

DETAILED DESCRIPTION OF THE PREFERRED EMBODIMENT

An outboard motor control apparatus according to an embodiment of the invention will now be explained with reference to the attached drawings.

Figure 1:
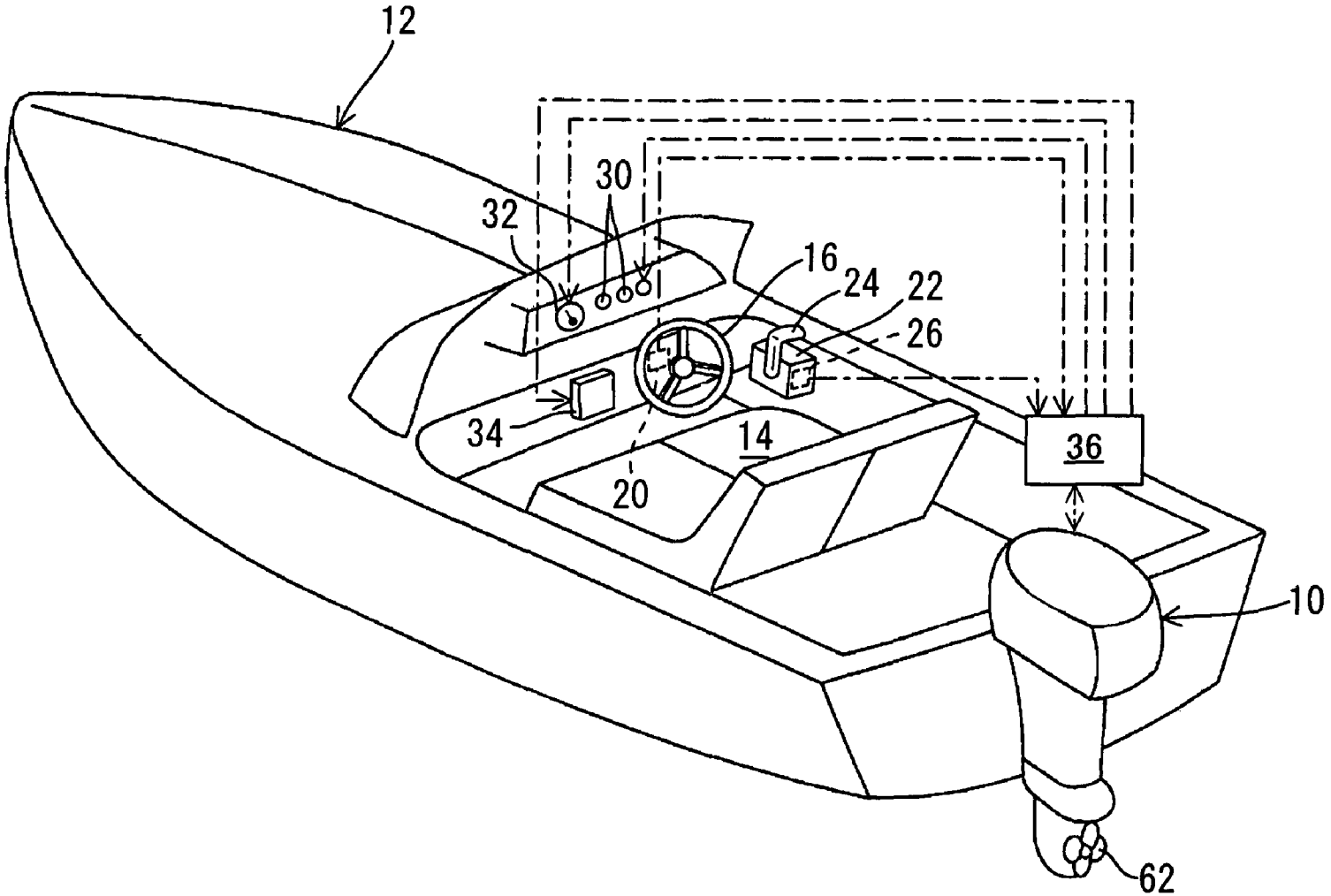
FIG. 1 is an overall perspective view of an outboard motor clamped to a boat to which the outboard motor control apparatus according to an embodiment of the invention is applied.

FIG. 1 is an overall perspective view of an outboard motor clamped to a boat to which the outboard motor control apparatus according to the embodiment of the invention is applied.

In FIG. 1, reference numeral 10 indicates an outboard motor. As illustrated, the outboard motor 10 is clamped to the stern or transom of a boat (hull) 12. As will be explained later, three models of outboard motors 10 are prepared.

A steering wheel 16 is installed near a cockpit or operator's seat 14 of the boat 12. A steering wheel angle sensor 20 is installed near a rotary shaft (not shown) of the steering wheel 16 and produces an output or signal indicative of the steering angle of the steering wheel 16 manipulated by the operator.

A remote control box 22 is installed near the cockpit 14. The remote control box 22 is provided with a shift/throttle lever 24 to be manipulated by the operator. The shift/throttle lever 24 can be manipulated fore and aft from its initial position to input shift position change command and engine speed regulation command. A shift/throttle lever position sensor 26 is installed at the remote control box 22 and produces an output or signal corresponding to the position to which the shift/throttle lever 24 is manipulated by the operator.

A group of indicator lamps 30, a tachometer 32 and a display 34 for displaying the operating condition of the outboard motor 10, etc. are installed at the dashboard of the cockpit 14 where the steering wheel 16 is installed. An Electronic Control Unit (hereinafter referred to as "ECU") 36 is installed at an appropriate location on the boat 12.

Figure 2:
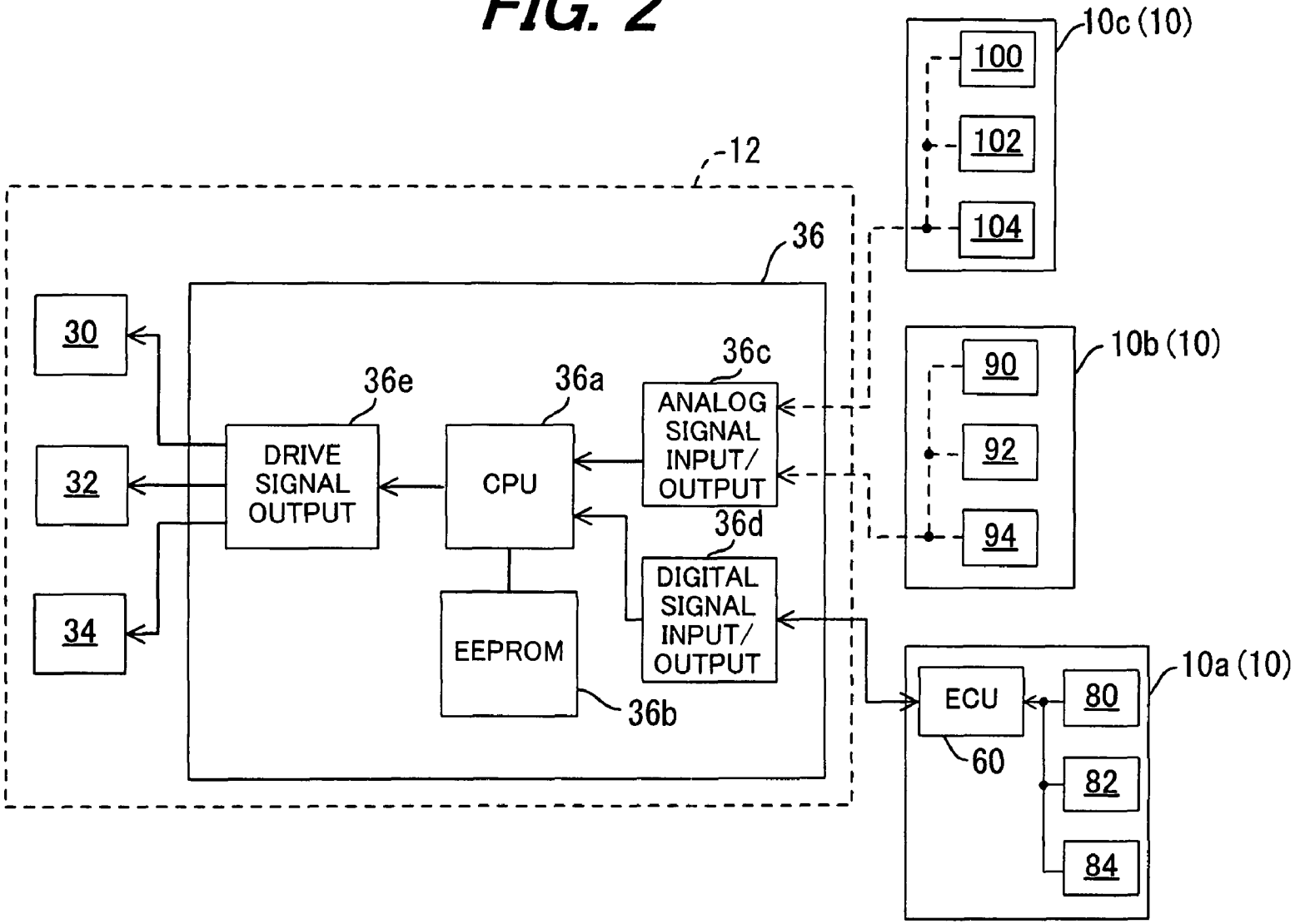
FIG. 2 is a block diagram showing the structure of an ECU (Electronic Control Unit) and other elements shown in FIG. 1.

FIG. 2 is a block diagram showing the structure of the ECU 36 and other elements. For the brevity of illustration, the steering wheel angle sensor 20 and shift/throttle lever position sensor 26 installed on the boat and actuators installed in the outboard motor 10 and connected to the shift mechanism and throttle valve (explained later) are omitted.

The ECU 36 comprises a microcomputer and as illustrated in FIG. 2, has a CPU 36*a*, EEPROM (Electrically Erasable and Programmable Read Only Memory; nonvolatile memory) 36*b*, an analog signal input/output 36*c* for inputting analog signals, a digital signal input/output 36*d* for inputting digital signals and a drive signal output 36*e* that is connected to the indicator lamps 30, tachometer 32 and display 34 and outputs the drive signal thereto.

As mentioned above, the outboard motor control apparatus according to the embodiment is prepared with three models of outboard motors 10, and one from among them selected by the operator (user) is clamped to the boat 12. As shown in FIG. 2, the three models of outboard motors 10 are 10*a*, 10*b* and 10*c* and are made different in engine power and devices mounted thereon. The three models 10*a*, 10*b*, 10*c* of the outboard motors 10 are hereinafter referred to as "1st outboard motor 10*a*", "2nd outboard motor 10*b*" and "3rd outboard motor 10*c*".

Figure 3:
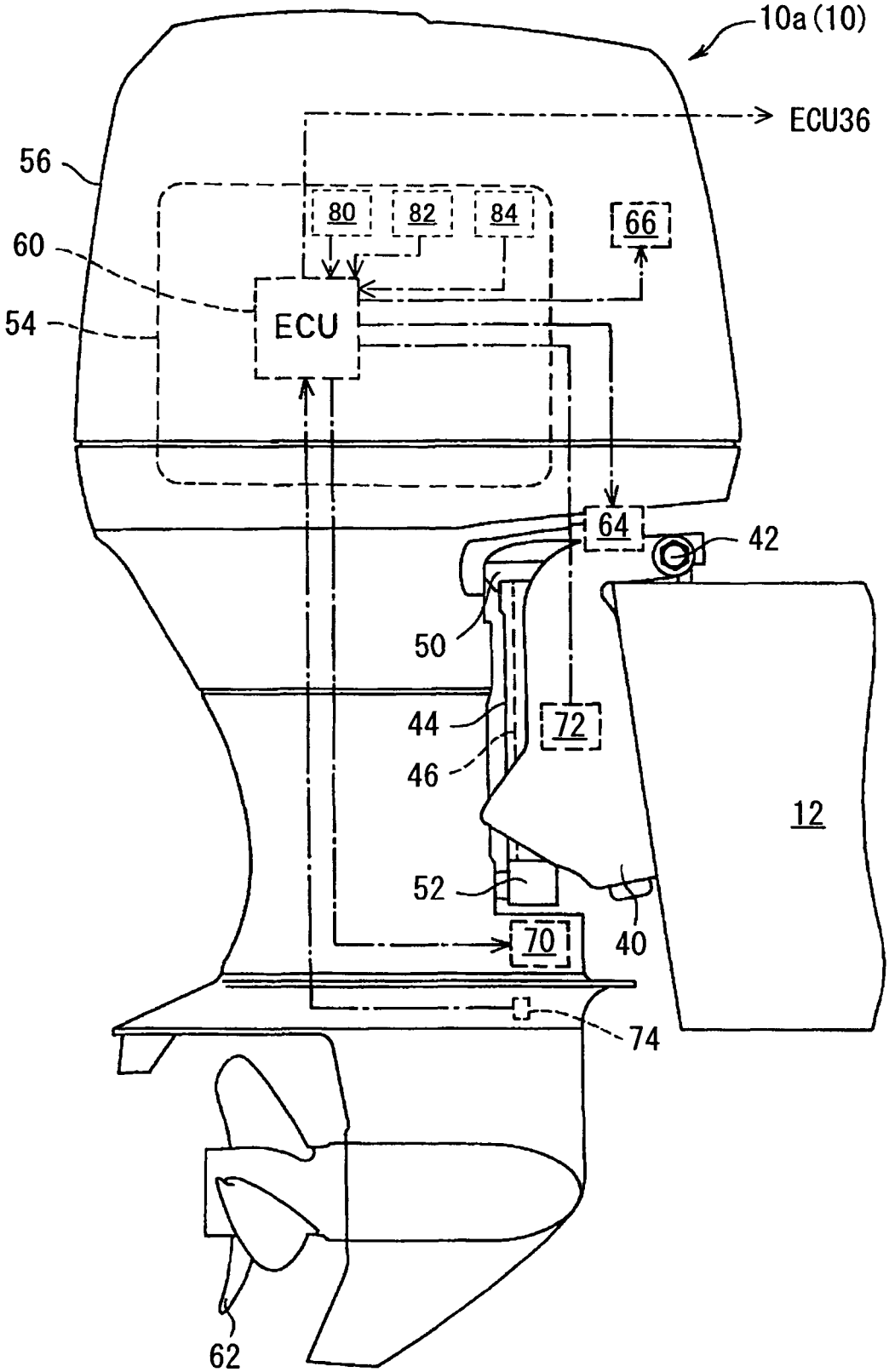
FIG. 3 is an enlarged side view of the outboard motor shown in FIG. 1.

FIG. 3 is an enlarged side view of the 1st outboard motor 10*a*.

Explaining the 1st outboard motor 10*a* with reference to FIG. 3, the 1st outboard motor 10*a* is clamped to the stern or transom of the boat 12 through stern brackets 40. A swivel case 44 is attached to the stern brackets 40 through a tilting shaft 42 such that the outboard motor 10*a* can tilt relative to the boat 12. A swivel shaft 46 is housed in the swivel case 44 to be freely rotated about a vertical axis.

The swivel shaft 46 is fixed to a mount frame 50 at its upper end and to a lower mount center housing 52 at its lower end. The mount frame 50 and lower mount center housing 52 are fixed to a frame that constitutes the main body of the 1st outboard motor 10*a*. With this, the operator can tilt/trim the outboard motor 10*a* about the tilting shaft 42 and can steer it about the swivel shaft 46.

The 1st outboard motor 10*a* is equipped with an internal combustion engine (hereinafter referred to as "engine") 54 at its upper portion. The engine 54 comprises a spark-ignition gasoline engine and is located above the water surface and covered by an engine cover 56. An Electronic Control Unit (hereinafter referred to as "outboard motor ECU") 60 is installed beneath the engine cover 56 at a location near the engine 54.

The power of the engine 54 is transmitted downward, via a vertical shaft and a shift mechanism including a clutch (neither shown) to a propeller 62. The propeller 62 is rotated by the power transmitted from the engine 64 and produces thrust for propelling the boat 12 forward and rearward.

The 1st outboard motor 10*a* is equipped with an electric steering motor 64 for rotating the mount frame 50 about the swivel shaft 46 to steer the outboard motor 10*a* to the right and left directions relative to the boat 12, an electric throttle motor 66 for opening/closing the throttle valve of the engine 54 to regulate the engine speed, an electric shift motor 70 for driving the shift mechanism to change the shift position (i.e., forward or reverse), and a power tilt/trim unit 72 having an electric motor for regulating the tilt/trim angle. A shift position sensor 74 is installed near the electric shift motor 70 and produces an output or signal indicative of the shift posit-ion.

The outboard motor ECU 60 controls the operation of the electric steering motor 64, electric throttle motor 66, electric shift motor 70 and electric motor of the power tilt/trim unit 72 based on the outputs of the steering wheel angle sensor 20, shift/throttle lever position sensor 26 and shift position sensor 74.

The 1st outboard motor 10*a* is thus configured to be an outboard motor with the DBW mechanism, and the steering, shift change and engine speed regulation are achieved by controlling the operation of the electric motors 64, 66 and 70.

The 1st outboard motor 10*a* is further equipped with a first oil pressure switch 80 installed at an oil (lubricant) supply path for the engine 54 at a location downstream of an oil pump (not shown) and producing an output or signal indicative of the pressure at the high-pressure side, a second oil pressure switch 82 installed at the oil path at a location upstream of the oil pump and producing an output or signal indicative of the pressure at the low-pressure side, and a crank angle sensor 84 constituted as electromagnetic pickup that is installed at a location near the crankshaft of the engine 54 and produces a pulse signal once per predetermined crank angular position. These are devices that produce analog signals.

The 1st outboard motor 110*a* is configured such that, at initial state where no oil pressure is exerted in the oil path, the first oil pressure switch 80 produces a Hi (analog) signal and the second oil pressure switch 82 produces a Lo (analog) signal. The outputs of the first and second oil pressure switches 80, 82 and crank angle sensor 84 are sent to the outboard motor ECU 60.

The outboard motor ECU 60 converts the outputs of the pressure switches 80, 82 to digital signals and outputs them. Further, the outboard motor ECU 60 counts the number of pulse signals of the crank angle sensor 84 to detect the engine speed, converts it to a digital signal and outputs it.

Further, when a model code request command is sent from the ECU 36, the outboard motor ECU 60 reads a digital signal corresponding to the model code (indicative of the model, e.g., the 1st outboard motor 10*a*) stored in the ROM and sends it to the ECU 36.

When the 1st outboard motor 10*a* is selected and clamped to the boat 12, the outputs of the outboard motor ECU 60 are supplied to the ECU 36 and are inputted to the ECU 36 through the digital signal input/output 36*d*.

The 2nd outboard motor 10*b* will be explained.

Explaining this with focus on the differences from the 1st outboard motor 10*a*, the 2nd outboard motor 10*b* has an internal combustion engine whose power or displacement is smaller than the engine 54. Although not shown, the 2nd outboard motor 10*b* is also equipped with the electric steering motor, electric throttle motor, electric shift motor and power tilt/trim unit. However, the 2nd outboard motor 10*b* is not equipped with the ECU. Instead, the electric steering motor and other motors are controlled by the ECU 36 installed on the boat 12.

In the 2nd outboard motor 10*b*, it is configured such that, at initial state where no oil pressure is exerted in the oil path, the first oil pressure switch (now assigned with reference numeral 90) produces a Hi (analog) signal and the second oil pressure switch (now assigned with reference numeral 92) produces a Lo (analog signal). The crank angle sensor is now assigned with reference numeral 94.

When the 2nd outboard motor 10*b* is selected and clamped to the boat 12, the outputs of the first and second oil pressure switches 90, 92 and crank angle sensor 94 are supplied to the ECU 36 and are inputted to the ECU 36 through the analog signal input/output 36*c*.

The rest of the configuration of the 2nd outboard motor 10*b* is the same as the 1st outboard motor 10*a*.

The 3rd outboard motor 10*c* will be explained.

Explaining this with focus on the differences from the 2nd outboard motor 10*b*, the 3rd outboard motor 10*c* has an internal combustion engine whose power or displacement is still smaller than the engine of the 2nd outboard motor 10*b*. Like the 2nd outboard motor 10*b*, the 3rd outboard motor 10*c* is also equipped with the electric steering motor, electric throttle motor, electric shift motor and power tilt/trim unit, but is not equipped with the ECU. The electric steering motor and other motors are controlled by the ECU 36 installed on the boat 12.

Contrary to the 1st and 2nd outboard motors 10*a*, 10*b*, in the 3rd outboard motor 10*c*, it is configured such that, at initial state where no oil pressure is exerted in the oil path, the first oil pressure switch (now assigned with reference numeral 100) produces a Lo (analog) signal and the second oil pressure switch (now assigned with reference numeral 102) produces a Hi (analog) signal. The crank angle sensor is now assigned with reference numeral 104.

Similarly, when the 3rd outboard motor 10*c* is selected and clamped to the boat 12, the outputs of the first and second oil pressure switch 100, 102 and crank angle sensor 104 are supplied to the ECU 36 and are inputted to the ECU 36 through the analog signal input/output 36*c*.

The rest of the configuration of the 3rd outboard motor 10*c* is the same as the 1st outboard motor 10*a*.

Figure 4:
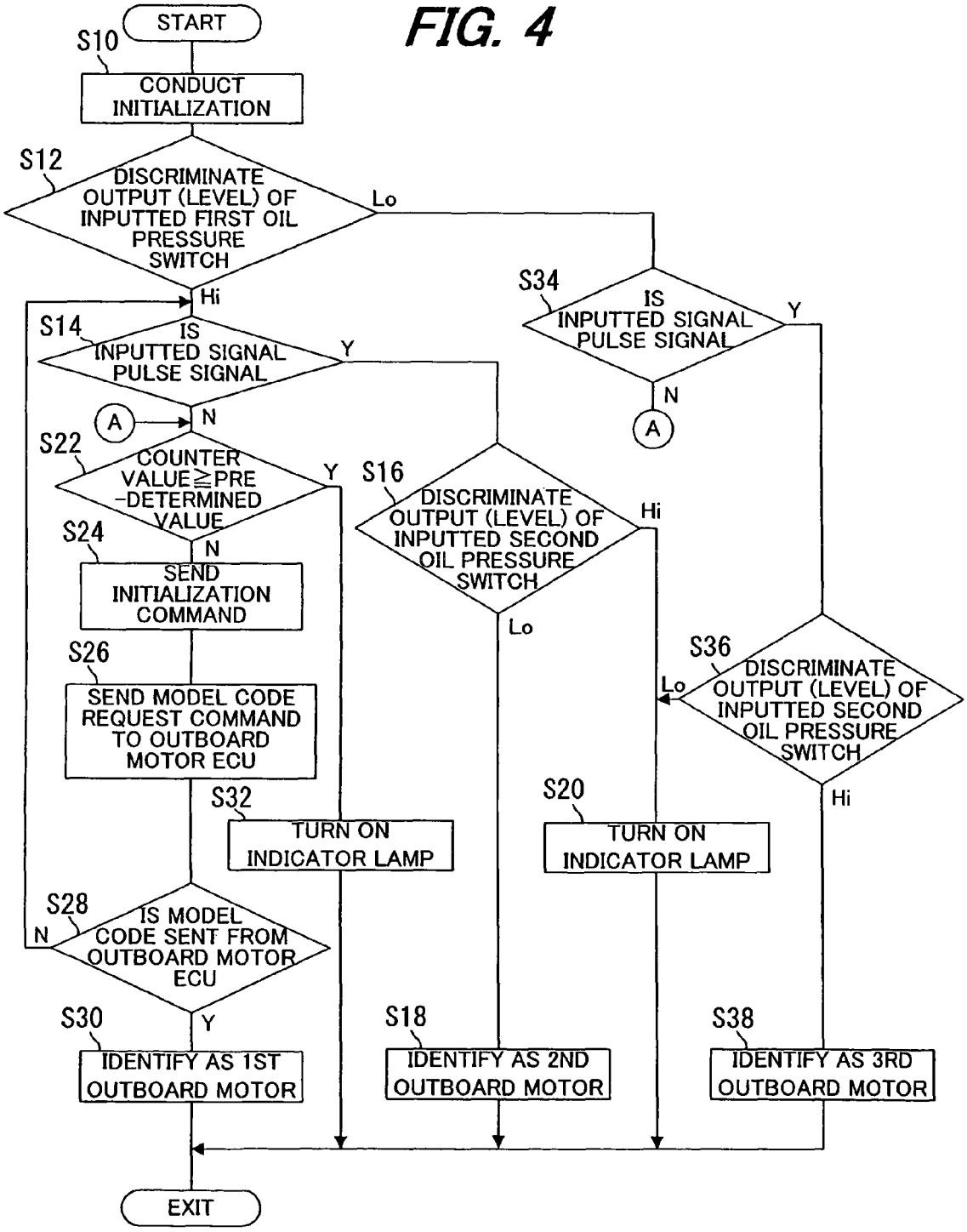
FIG. 4 is a flowchart showing the operation of the outboard motor control apparatus according to the embodiment partly shown in FIGS. 1 and 2.

FIG. 4 is a flowchart showing the operation of the outboard motor control apparatus according to the embodiment, more specifically identification of the one selected by the operator from among the 1st to 3rd outboard motors 10*a*, 10*b*, 10*c*. The program is executed by the ECU 36 when a start key is manipulated by the operator and operating power is supplied from a battery (not shown).

The program starts in S10 in which initialization is conducted and proceeds to S12 in which the output (level) of the first oil pressure switch sent from the selected outboard motor 10 and inputted through the analog signal input/output 36*c* or digital signal input/output 36*d* is discriminated.

As mentioned above, since the output (level) in the initial state of the first oil pressure switches 80, 90 of the 1st and 2nd outboard motors 10*a*, 10*b* is in inverse relation to that of the switch 100 of the 3rd outboard motor 10*c*, the output will be Hi if the 1st or 2nd outboard motor 10*a*, 10*b* is selected, while it will be Lo if the 3rd one 10*c* is selected.

When the result of S12 is Hi, the program proceeds to S14 in which it is discriminated whether the inputted signal is pulse signal (analog signal). In other words, it is discriminated whether the inputted signal is an analog signal or a digital signal. This amounts to determining whether the selected outboard motor 10 is the model that has the device which outputs the digital signal, i.e., the 1st outboard motor 10*a*.

When the result is affirmative in S14, the program proceeds to S16 in which the output (level) of the second oil pressure switch sent from the selected outboard motor 10 and inputted through the analog signal input/output 36*c* or digital signal input/output 36*d* is discriminated. In the 2nd outboard motor 10*b*, the output in the initial state of the first oil pressure switch 90 is Hi, but the output of the second oil pressure switch 92 is Lo.

When the result of S16 is Lo, the program accordingly proceeds to S18 in which it is identified that the selected one is the 2nd outboard motor 10*b*.

On the contrary, when the result of S16 is Hi, the program proceeds to S20 in which the indicator lamp 30 is turned on to alert the operator. In other words, it is determined that some communication error may occur between the first and/or second oil pressure switch 90, 92 and ECU 36 and identification of the selected outboard motor is suspended.

On the other hand, when the result is negative in S14, since it can be determined that the selected one is the 1st outboard motor 10*a*, the program proceeds to S22 in which the value of a counter is equal to or greater than a predetermined value (e.g., the value corresponding to 5 minutes). The counter is started to count up in a routine not shown each time the result in S14 (or S34) is negative.

The result in S22 is normally negative when the program proceeds to this step for the first time, and the program proceeds to S24 in which an initialization command is sent to the outboard motor ECU 60 of the 1st outboard motor 10*a* to conduct initialization.

Then the program proceeds to S26 in which a model code request command (requesting a model code indicative of the 1st outboard motor 10*a*) is sent to the outboard motor ECU 60 and proceeds to S28 in which it is determined whether the model code (in digital signal) is sent from the outboard motor ECU 60.

When the result is affirmative, the program proceeds to S30 in which it is identified that the selected one is the 1st outboard motor 10*a*.

On the contrary, when the result in S28 is negative, the program proceeds back to S14 and the above-mentioned procedures are repeated. At that time, when the result in S22 becomes affirmative, the program proceeds to S32 in which the indicator lamp 30 is turned on to alert the operator. In other words, it is determined that some communication error may occur between the outboard motor ECU 60 and ECU 36 and identification of the selected outboard motor is suspended.

On the other hand, when the result of S12 is Lo, the program proceeds to S34 in which it is determined whether the pulse signal (analog signal) is sent from the selected outboard motor 10.

Like the procedure in S14, it is determined in S34 whether the inputted signal is pulse signal (analog signal). In other words, it is discriminated whether the inputted signal is an analog signal or a digital signal.

When the result is negative, the program proceeds to S22 and on to conduct the procedures mentioned above.

However, when the result is affirmative, the program proceeds to S36 in which the output (level) of the second oil pressure switch sent from the selected outboard motor 10 and inputted through the analog signal input/output 36*c* or digital signal input/output 36*d* is discriminated. In the 3rd outboard motor 10*c*, the output in the initial state of the first oil pressure switch 100 is Lo and the output of the second oil pressure switch 102 is Hi.

When the result of S36 is Hi, the program accordingly proceeds to S38 in which it is identified that the selected one is the 3rd outboard motor 10*c*.

On the contrary, when the result of S36 is Lo, the program proceeds to S20 in which the indicator lamp 30 is turned on to alert the operator. In other words, it is determined that some communication error may occur between the first and/or second oil pressure switch 100, 102 and ECU 36 and identification of the selected outboard motor is suspended.

When the model of outboard motor 10 selected and clamped to the boat 12 is identified, the ECU 36 controls the operation of the identified model and outputs drive signals to the display 34 and the like through the drive signal output 36*e*.

As stated above, the embodiment is thus configured to have an apparatus (ECU 36) installed on a boat (12) for or method of identifying and controlling operation of an outboard motor (10) selected by an operator and clamped to the boat from among outboard motors in different models (10*a*, 10*b*, 10*c*) prepared to be selectable by the operator, the outboard motors including a model (10*b*, 10*c*) having an analog device (first and second oil pressure switch 90, 92, 100, 102, crank angle sensor 94, 104) that produces analog signal and a model (10*a*) having a digital device (outboard motor ECU 60) that converts the analog signal produced by the analog device (first and second oil pressure switch 80, 82, crank angle sensor 84) into a digital signal, comprising: an analog signal input/output (36*c*) that is able to input/output the analog signal produced by the analog device; a digital signal input/output (36*d*) that is able to input/output the digital signal produced by the digital device; and a model identifier (CPU 36*a*, S10 to S38) that discriminates whether the inputted signal is the analog signal inputted through the analog signal input/output or the digital signal inputted through the digital signal input/output, and identifies the model of the selected outboard motor based on the discriminated signal.

With this, it becomes possible to surely identify the model of the selected outboard motor 10 selected from among the outboard motor models 10*a*, 10*b*, 10*c* and clamped to the boat 12 and to control its operation in an appropriate manner. By identifying the model of the selected outboard motor, it becomes possible to communicate an auto-steering system, if any and the electric steering motor 64, electric throttle motor 66, electric shift motor 70 and electric motor of the power tilt/trim unit 72 and any other devices.

In the apparatus or method, the outboard motors include a first model (2nd outboard motor 10*b*) having the analog device (first and second oil pressure switch 90, 92, crank angle sensor 94) that produces analog signal in one of high (Hi) and low (Lo) levels and a second model (3rd outboard motor 10*c*) having the analog device (first and second oil pressure switch 100, 102, crank angle sensor 104) that produces analog signal in the other of high and low levels, and the model identifier discriminates the level of the inputted signal and identifies the model of the selected outboard motor from the first and second models based on the level of the inputted signal when the inputted signal is discriminated to be the analog signal (CPU 36*a*, S12 to S18, S34 to S38). With this, it becomes possible to surely identify the model of the selected outboard motor 10 selected from among the outboard motor models 10*b*, 10*c* and clamped to the boat 12 and to control its operation in an appropriate manner.

In the apparatus or method, the first model (2nd outboard motor 10*b*) has a first analog device (first and second oil pressure switch 90, 92, crank angle sensor 94) that produces analog signal in one of high and low levels and a second analog device that produces analog signal in the other of high and low levels, the second model (3rd outboard motor 10*c*) has a third analog device that produces analog signal in the other of high and low levels and a fourth analog device (first and second oil pressure switch 100, 102, crank angle sensor 104) that produces analog signal in the one of the high and low levels, and the model identifier discriminates the level of the inputted signals and identifies the model of the selected outboard motor from first and second models based on the level of the inputted signal when the inputted signal is discriminated to be the analog signal (CPU 36*a*, S12 to S18, S34 to S38). With this, it becomes possible to surely identify the model of the selected outboard motor 10 selected from among the outboard motor models 10*b*, 10*c* and clamped to the boat 12 and to control its operation in an appropriate manner.

In the apparatus or method, the model identifier identifies the model of the selected outboard motor based on a model code sent from the digital device (outboard motor ECU 60) of the selected outboard motor (10*a*) when the inputted signal is discriminated to be the digital signal (CPU 36*a*, S12 to S14, S22 to S30). With this, it becomes possible to surely identify the model of the selected outboard motor 10 selected from the outboard motor model 10*a* and clamped to the boat 12 and to control its operation in an appropriate manner.

In the apparatus or method, the model identifier identifies the model of the selected outboard motor immediately after operating power is supplied from a battery and initialization is conducted (CPU 36*a*, S10). With this, it becomes possible to surely and promptly identify the model of the selected outboard motor 10.

It should be noted that, although three models 10*a*, 10*b*, 10*c* of the outboard motors 10 are prepared, the invention should not be limited thereto and two or more than three models can be prepared.

Japanese Patent Application No. 2007-272643 filed on Oct. 19, 2007 is incorporated herein in its entirety.

While the invention has thus been shown and described with reference to specific embodiments, it should be noted that the invention is in no way limited to the details of the described arrangements; changes and modifications may be made without departing from the scope of the appended claims.

What is claimed is:

1. An apparatus installed on a boat for identifying and controlling operation of an outboard motor selected by an operator and clamped to the boat from among a plurality of outboard motors having different models prepared to be selectable by the operator, the plurality of outboard motors including at least one analog model that communicates via an analog signal and at least one digital model that communicates via a digital signal, comprising:

an analog signal input/output component that is able to input/output the analog signal produced by the at least one analog model;

a digital signal input/output component that is able to input/output the digital signal produced by the at least one digital model;

a model identifier that identifies the model of the selected outboard motor based on discriminating whether the inputted signal is the analog signal inputted through the analog signal input/output or the digital signal inputted through the digital signal input/output; and a controller configured to control the model of the selected outboard motor using engine control signals that are particularized to the model identified by the model identifier, wherein the at least one analog model includes a first model that produces analog signals in one of high and low levels and a second model that produces analog signals in opposing high and low levels, and wherein the model identifier further identifies the model of the selected outboard motor from the first and second models based on discriminating the level of the inputted analog signal, and wherein the first model has a first analog device of a first type that produces analog signals in high levels and a second analog device of a second type that produces analog signals in low levels, and wherein the second model has a third analog device of a first type that produces analog signals in low levels and a fourth analog device of a second type that produces analog signals in the high levels, and wherein the model identifier further identifies the model of the selected outboard motor from first and second models based on discriminating between signals from the first type of analog devices and the second type of analog devices and on the level of the inputted signals.

2. The apparatus according to claim 1, wherein the at least one digital model includes a first digital model having a digital device configured to output a model code to the digital signal input/output component and wherein the model identifier identifies the model of the selected outboard motor based on the model code sent from the digital device of the selected outboard motor when the inputted signal is discriminated to be the digital signal.

3. The apparatus according to claim 1, wherein the model identifier identifies the model of the selected outboard motor immediately after operating power is supplied from a battery and initialization is conducted.

4. A method of identifying and controlling operation of an outboard motor selected by an operator and clamped to a boat from among a plurality of outboard motors having different models prepared to be selectable by the operator, the plurality of outboard motors including at least one analog model that communicates via an analog signal and at least one digital model that communicates via a digital signal, comprising the steps of:

receiving one of an analog signal and a digital signal respectively by an analog input/output component that is able to input/output the analog signal produced by the at least one analog model and a digital signal input/output component that is able to input/output the digital signal produced by the digital model, discriminating whether the received signal is the analog signal inputted through the analog signal input/output component or the digital signal inputted through the digital signal input/output component;

identifying the model of the selected outboard motor based on the discriminated signal; and controlling the model of the selected outboard motor using engine control signals that are particularized to the identified model, wherein the at least one analog model includes a first model that produces analog signals in one of high and low levels and a second model that produces analog signals in opposing high and low levels, and wherein the step of discriminating discriminates the level of the inputted signal and the step of identifying identifies the model of the selected outboard motor from the first and second models based on the discriminated level of the inputted analog signals, and wherein the first model has a first analog device of a first type that produces analog signals in high levels and a second analog device of a second type that produces analog signals in low levels, and wherein the second model has a third analog device of a first type that produces analog signals in low levels and a fourth analog device of a second type that produces analog signals in the high levels, and wherein the step of discriminating discriminates between signals from the first and second type of analog devices and between the level of the inputted signals and wherein the step of identifying identifies the model of the selected outboard motor from first and second models based on the discrimination between signals from the first type of analog devices and the second type of analog devices and on the level of the inputted signals when the inputted signal is discriminated to be the analog signal.

5. The method according to claim 4, wherein the at least one digital model includes a first digital model having a digital device configured to output a model code to the digital signal input/output component and wherein the step of identifying identifies the model of the selected outboard motor based on the model code sent from the digital device of the selected outboard motor when the inputted signal is discriminated to be the digital signal.

6. The method according to claim 4, wherein the steps of discriminating and identifying discriminates and identifies the model of the selected outboard motor immediately after operating power is supplied from a battery and initialization is conducted.

7. The method according to claim 4, wherein the engine control signals are configured based on whether the model of the selected outboard motor includes an ECU or relies on the controller for direct control of a plurality of motor components.

8. The apparatus according to claim 1, wherein the engine control signals are configured based on whether the model of the selected outboard motor includes an ECU or relies on the controller for direct control of a plurality of motor components.

* * * * *